US009902078B2

(12) United States Patent
Lopez

(10) Patent No.: US 9,902,078 B2
(45) Date of Patent: Feb. 27, 2018

(54) ADJUSTABLE SHAVING DEVICE

(71) Applicant: Juan Lopez, Panorama City, CA (US)

(72) Inventor: Juan Lopez, Panorama City, CA (US)

( * ) Notice: Subject to any disclaimer, the term of this patent is extended or adjusted under 35 U.S.C. 154(b) by 217 days.

(21) Appl. No.: 14/921,120

(22) Filed: Oct. 23, 2015

(65) Prior Publication Data

US 2017/0113363 A1 Apr. 27, 2017

(51) Int. Cl.

*B26B 21/52* (2006.01)
*B26B 21/40* (2006.01)
*B26B 21/22* (2006.01)

(52) U.S. Cl.

CPC ..... *B26B 21/521* (2013.01); *B26B 21/227* (2013.01); *B26B 21/4037* (2013.01); *B26B 21/523* (2013.01); *B26B 21/522* (2013.01)

(58) Field of Classification Search

CPC ..... B26B 21/521; B26B 21/4037; B26B 21/4062; B26B 21/52; B26B 21/522; B26B 21/523; B26B 21/227

USPC ..... 30/54, 57, 74.1, 526, 527, 529, 530, 534

See application file for complete search history.

(56) References Cited

U.S. PATENT DOCUMENTS 868,697 A * 10/1907 Wilcox et al. ..... B26B 21/18 30/346.57
996,617 A * 7/1911 Cobb L ..... B26B 21/16 30/534
1,552,234 A * 9/1925 Roebuck ..... B26B 21/52 30/346.61
1,652,154 A * 12/1927 Libi ..... B26B 21/16 30/346.5
2,309,549 A * 1/1943 Robinson ..... B26B 21/18 30/526
2,668,350 A * 2/1954 Graybill ..... B26B 21/32 30/526
3,570,123 A 3/1971 Kuhnl
3,619,900 A 11/1971 Matsuura
3,740,842 A 6/1973 Bleuer
3,777,396 A * 12/1973 Simonetti ..... B26B 21/22 30/346.57

(Continued)

FOREIGN PATENT DOCUMENTS

CH 226074 A * 3/1943 ..... B26B 21/28
CH 652963 A5 * 12/1985 ..... B26B 21/185

(Continued)

OTHER PUBLICATIONS

English Translation of FR784362.*

*Primary Examiner* — Jennifer Swinney

(57) ABSTRACT

An adjustable shaving device for shaving includes a housing that is generally cylindrical. The housing has a second end that comprises an orifice. A neck is positioned in the orifice and a first coupler is rotationally coupled to the neck. The device includes a blade assembly comprising a plurality of safety blades, a male cover, a female cover, and a plurality of spacers. The covers and spacers are complimentary to the blades, and the spacers are positionable between the blades. A second coupler, complimentary to the first coupler, is positioned on an exterior face of the female cover. The male cover and the female cover are configured to accept and secure the blades with one spacer between adjacent blades. The first coupler is positioned to couple to the second coupler, securing the blade assembly to the neck and allowing rotational movement of the blade assembly.

16 Claims, 5 Drawing Sheets

(56) References Cited

U.S. PATENT DOCUMENTS

| | | | | | |
|---|---|---|---|---|---|
| 3,842,502 | A | * | 10/1974 | Hagan | B26B 21/54 30/346.57 |
| 3,964,159 | A | * | 6/1976 | Ferraro | B26B 21/4018 30/47 |
| 4,026,016 | A | * | 5/1977 | Nissen | B26B 21/225 30/47 |
| 4,955,139 | A | | 9/1990 | Diaz-Rivers | |
| 5,331,740 | A | * | 7/1994 | Carson, III | B26B 21/222 30/41 |
| 5,560,106 | A | * | 10/1996 | Armbruster | B26B 21/522 30/526 |
| 6,725,550 | B1 | | 4/2004 | Shah | |
| 7,086,160 | B2 | | 8/2006 | Coffin et al. | |
| 7,721,451 | B2 | | 5/2010 | Psimadas et al. | |
| 2008/0184563 | A1 | | 8/2008 | Hamadeh | |
| 2012/0291295 | A1 | | 11/2012 | Braun | |
| 2015/0283716 | A1 | * | 10/2015 | Kim | B26B 21/225 30/526 |

FOREIGN PATENT DOCUMENTS

| | | | | | |
|---|---|---|---|---|---|
| DE | 803516 | C | * | 4/1951 | B26B 21/52 |
| FR | 784362 | A | * | 7/1935 | B26B 21/52 |
| GB | 156323 | A | * | 1/1921 | B26B 21/52 |
| GB | 326427 | A | * | 3/1930 | B26B 21/52 |
| GB | 1294666 | A | * | 11/1972 | B26B 21/165 |
| WO | WO2012044660 | | | 4/2012 | |

* cited by examiner

ADJUSTABLE SHAVING DEVICE

FIELD OF THE DISCLOSURE

The disclosure relates to shaving devices and more particularly pertains to a new adjustable shaving device for shaving.

SUMMARY OF THE DISCLOSURE

An embodiment of the disclosure meets the needs presented above by generally comprising a housing that is generally cylindrical. The housing has a second end that comprises an orifice. A neck is positioned in the orifice and a first coupler is rotationally coupled to the neck. The device includes a blade assembly comprising a plurality of safety blades, a male cover, a female cover, and a plurality of spacers. The covers and spacers are complimentary to the blades, and the spacers are positionable between the blades. A second coupler, complimentary to the first coupler, is positioned on an exterior face of the female cover. The male cover and the female cover are configured to accept and secure the blades with one spacer between adjacent blades. The first coupler is positioned to couple to the second coupler, securing the blade assembly to the neck and allowing rotational movement of the blade assembly.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
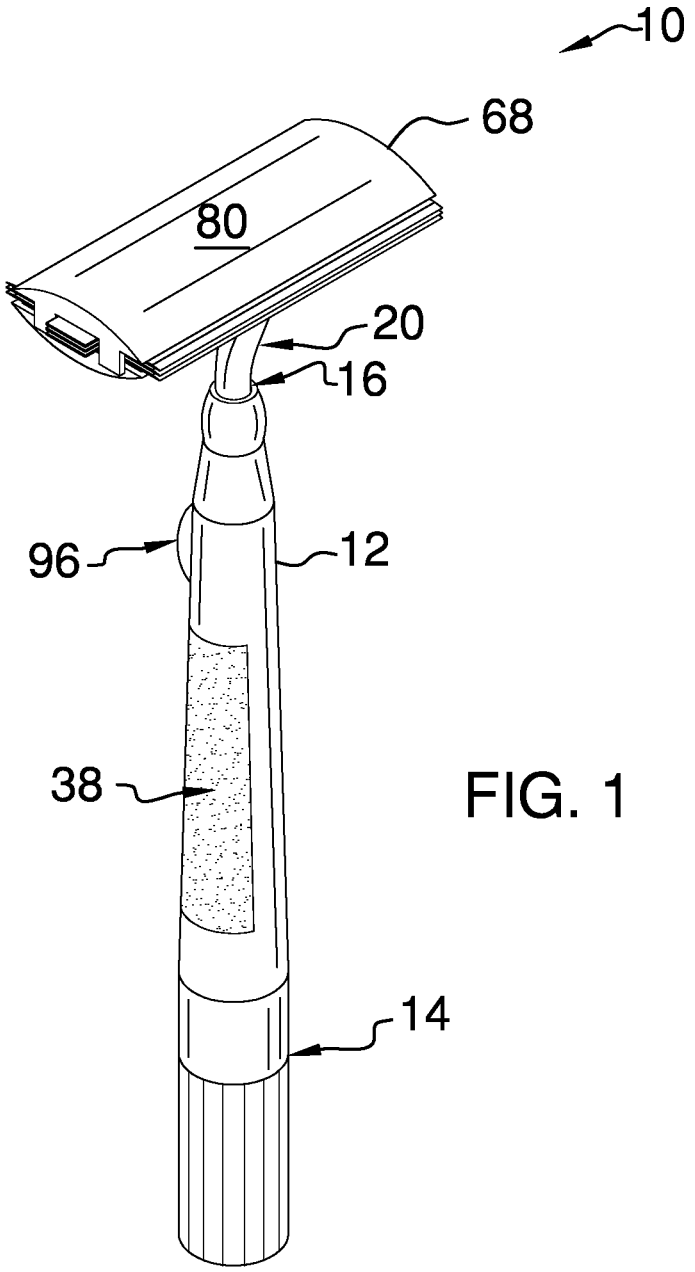
FIG. 1 is an isometric perspective view of an adjustable shaving device according to an embodiment of the disclosure.
Figure 2:
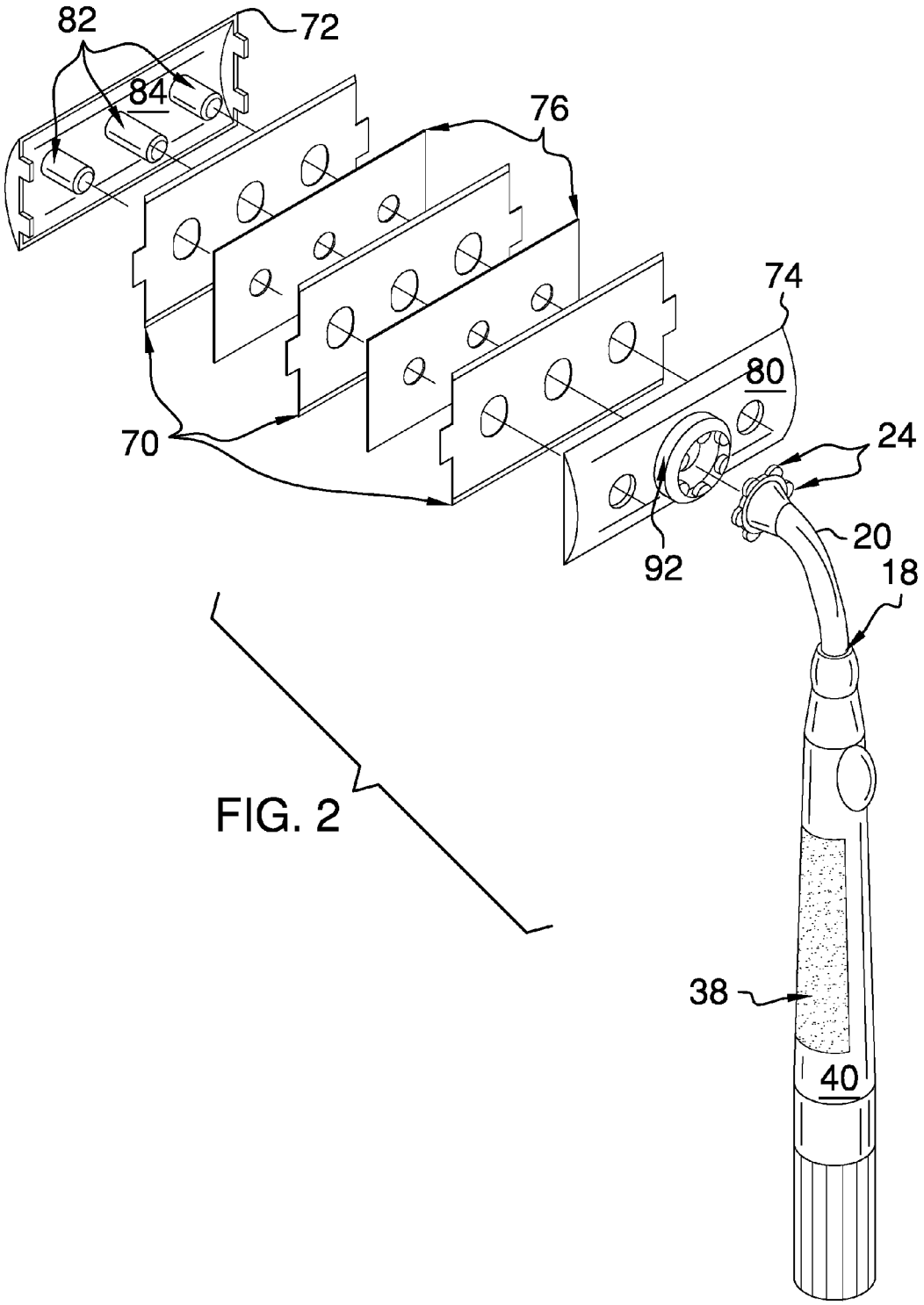
FIG. 2 is an exploded view of an embodiment of the disclosure.
Figure 3:
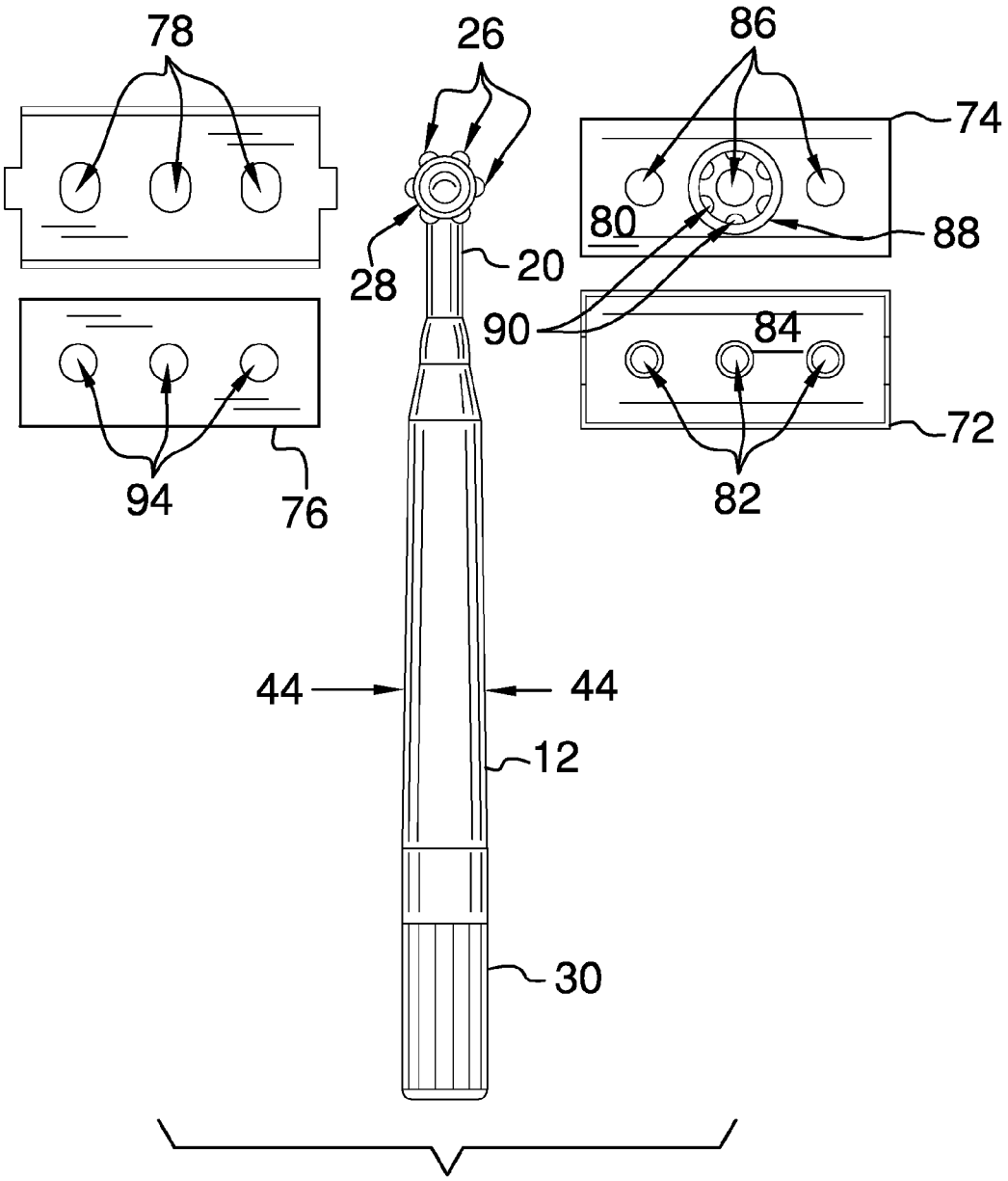
FIG. 3 is a front view of an embodiment of the disclosure.
Figure 4:
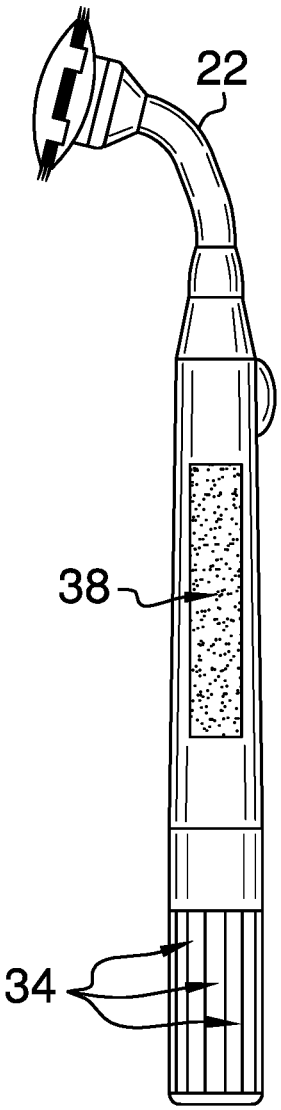
FIG. 4 is a side view of an embodiment of the disclosure.
Figure 5:
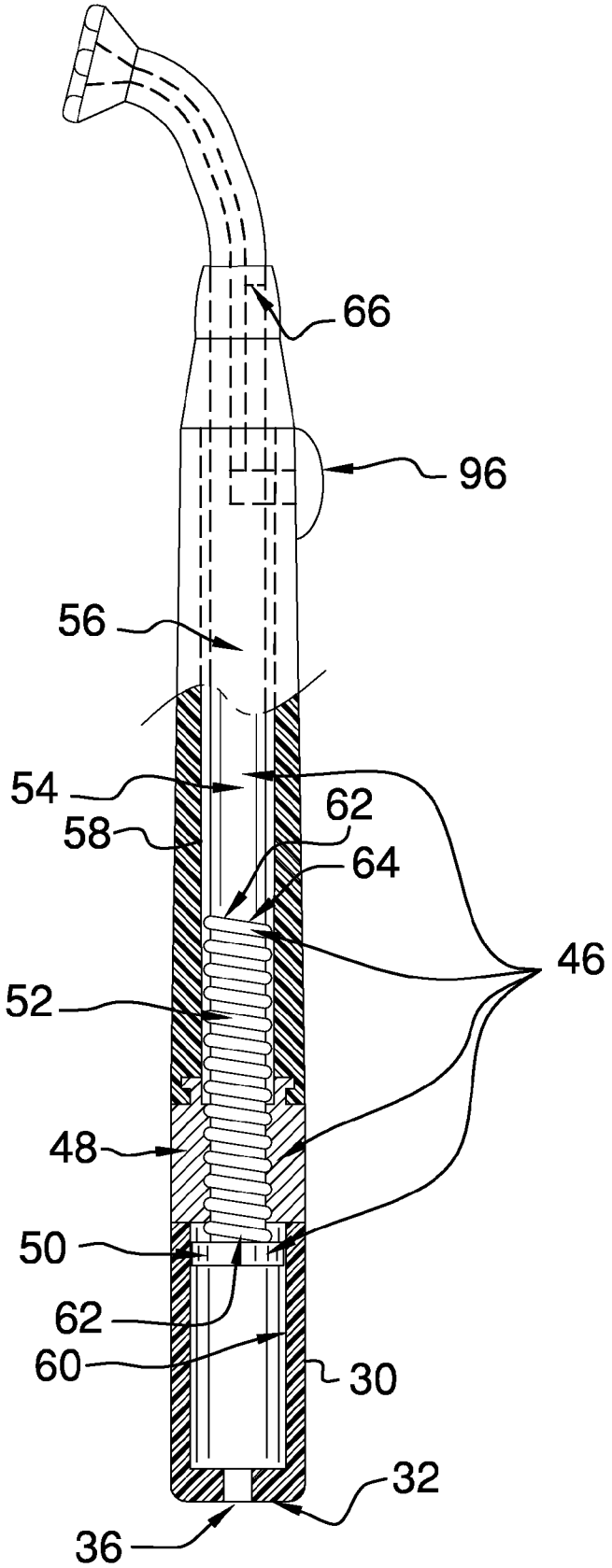
FIG. 5 is a cross-sectional view of an embodiment of the disclosure.

With reference now to the drawings, and in particular to FIGS. 1 through 5 thereof, a new shaving device embodying the principles and concepts of an embodiment of the disclosure and generally designated by the reference numeral 10 will be described.

As best illustrated in FIGS. 1 through 5, the adjustable shaving device 10 generally comprises a housing 12 that is generally cylindrical. The housing 12 has a first end 14 circumferentially larger than a second end 16, such that the housing 12 is slightly tapered. The second end 16 comprises an orifice 18. A neck 20 is positioned in the orifice 18. The neck 20 is generally cylindrical, curved, and variably positional within the housing 12, such that a desired curvature 22 of the neck 20 is obtainable by extending the neck 20 from the housing 12. A first coupler 24 is rotationally coupled to the neck 20. The first coupler 24 comprises a first plurality of arcuate protrusions 26 that extend outwardly from a perimeter ring 28. The first coupler 24 is rotationally and pivotally coupled to the neck 20.

A base 30 is rotationally coupled to the first end 14 of the housing 12. The base 30 has a bottom 32 that is tapered relative to the base 30. The base 30 comprises a plurality of longitudinal faces 34 that extend from the bottom 32 toward the first end 14. A penetration 36, preferably square, is positioned in the bottom 32 of the base 30, such that the penetration 36 is positioned in the bottom 32 allowing liquid to drain from the housing 12.

A grip 38 is coupled to an exterior 40 of the housing 12. The grip 38 is pliable, preferably rubber. The grip 38 may comprise a pair of grips 38, generally elongated rectangular shaped, positioned on opposing sides 44 of the housing 12.

An adjuster 46 that comprises a threaded section 48, a stop 50, a spring 52, and a shaft 54 is positioned in an interior space 56 defined by the housing 12 and the base 30. The threaded section 48 is positioned on an interior wall 58 of the housing 12 proximate to the first end 14. The stop 50 is coupled to an internal wall 60 of the base 30. The spring 52 is complimentary to the threaded section 48 and has a pair of ends 62. A respective one of the pair of ends 62 is coupled to the stop 50. The spring 52 extends through the threaded section 48 into the interior space 56 of the housing 12. The shaft 54 has a first terminus 64 and second terminus 66. The first terminus 64 is coupled to a respective one of the pair of ends 62 of the spring 52 within the interior space 56. The second terminus 66 is coupled to the neck 20 within the interior space 56, such that turning the base 30 relative to the housing 12 will rotate the spring 52 through the threaded section 48. The spring 52 thus induces the shaft 54 through the housing 12, such that the neck 20 protrudes from the housing 12 and forms the desired curvature 22 of the neck 20.

The device 10 includes a blade assembly 68 that comprises a plurality of safety blades 70, a male cover 72, a female cover 74 and a plurality of spacers 76. The safety blades 70 are substantially rectangular and have three openings 78. The covers 72 and 74 are complimentary to the safety blades 70 and have exterior faces 80. The exterior faces 80 are arcuately shape. The male cover 72 has three cylindrical protrusions 82 that extend from an inner face 84. The protrusions 82 are complimentary to the openings 78 in the safety blades 70. The female cover 74 has three orifices 86. The orifices 86 are complimentary to the protrusions 82. A second coupler 88 is positioned on the exterior face 80 of the female cover 74. The second coupler 88 is complimentary to the first coupler 24 and comprises a second plurality of arcuate protrusions 90 that extend internally from a cylinder 92 that is coupled to the exterior face 80 of the female cover 74. The second plurality of arcuate protrusions 90 is complimentary to the first plurality of arcuate protrusions 26, such that the second plurality of arcuate protrusions 90 is positioned to receive the first plurality of arcuate protrusions 26. The user may twist the blade assembly 68 relative to the first coupler 24 to secure the blade assembly 68 to the neck 20. The spacers 76 are complimentary to and positionable between the safety blades 70. Each of the spacers 76 has three holes 94 that are complimentary to the cylindrical protrusions 82. The plurality of spacers 76 comprises from one to four spacers, preferably two to three spacers. More preferably, the plurality of spacers comprises two spacers.

A release 96 is positioned on and extends through a back 98 of the housing 12. The release 96 is operationally coupled to the first coupler 24, such that the release 96 may be engaged by the user to disconnect the second coupler 88 from the first coupler 24.

In use, the male cover 72 and the female cover 74 are configured to accept and secure the safety blades 70 with one of each of the plurality of spacers 76 between adjacent safety blades 70. The first coupler 24 is positioned to couple to the second coupler 88, securing the blade assembly 68 to the neck 20 and allowing rotational movement of the blade assembly 68 relative to the housing 12. The desired curvature 22 of the neck 20 is obtained by threading the spring 52 through the threaded section 48, which moves the shaft 54 through the interior space 56, extending the neck 22 through the orifice 18.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An adjustable shaving device comprising:

a housing, said housing being cylindrical, said housing having a first end and a second end, said second end comprising an orifice;

a neck, said neck being positioned in said orifice;

a first coupler, said first coupler being rotationally coupled to said neck;

a blade assembly, said blade assembly comprising:

a plurality of safety blades, a male cover and a female cover, said covers being complementary to said safety blades wherein said safety blades are positionable in said covers, a second coupler positioned on an exterior face of said female cover, said second coupler being complimentary to said first coupler wherein said second coupler is selectively couplable to said first coupler, and a plurality of spacers, said spacers being complementary in shape to and positionable between said safety blades; and wherein said male cover and said female cover are configured to accept and secure said safety blades with one of each said plurality of spacers between adjacent said safety blades, and such that said first coupler is positioned to couple to said second coupler, securing said blade assembly to said housing and allowing rotational movement of said blade assembly relative to said housing; and a release, said release being positioned on and extending through said housing such that said release faces away from said blade assembly, said release being operationally coupled to said first coupler, wherein said release may be engaged by the user to disconnect said second coupler from said first coupler.

2. The device of claim 1, further including said first end of said housing being circumferentially larger than said second end, such that said housing is slightly tapered.

3. The device of claim 1, further including said neck being generally cylindrical, said neck being curved, said neck being variably positional within said housing.

4. The device of claim 1, further comprising:

said safety blades being rectangular and having three openings;

said covers having exterior faces, each said exterior face having an arcuate shape;

said male cover having three cylindrical protrusions extending from an inner face, said protrusions being complementary in position relative to said openings in said safety blades;

said female cover having three orifices, said orifices being complementary in position relative to said protrusions; and each of said spacers having three holes, said holes being complementary in position relative to said cylindrical protrusions.

5. The device of claim 1, further including said plurality of spacers comprising from one to four spacers.

6. The device of claim 5, further including said plurality of spacers comprising from two to three spacers.

7. The device of claim 6, further including said plurality of spacers comprising two spacers.

8. The device of claim 1, further comprising:

said first end being circumferentially larger than said second end, such that said housing is slightly tapered;

said neck being cylindrical, said neck being curved, said neck being variably positional within said housing;

said first coupler comprising a first plurality of arcuate protrusions extending from a perimeter ring;

a base, said base being rotationally coupled to said first end of said housing, said base having a bottom, said bottom being tapered relative to said base, said base comprising a plurality of longitudinal faces extending from said bottom toward said first end;

aperture, said aperture being positioned in said bottom of said base, said aperture being square, wherein said aperture is positioned in said bottom allowing liquid to drain from said housing;

a grip, said grip being coupled to an exterior of said housing, said grip being a pliable rubber, said grip comprising a pair of grips positioned on opposing sides of said housing, each of said pair of grips having a generally elongated rectangular shape;

an adjuster, said adjuster being positioned in an interior space defined by said housing and said base, said adjuster comprising:

a threaded section, said thread section being positioned on an interior wall of said housing proximate to said first end, a stop, said stop being coupled to an internal wall of said base, a spring, said spring being complementary to said threaded section wherein said spring is extendable through said threaded section to engage said threaded section, said spring having a pair of ends, a respective one of said pair of ends being coupled to said stop, said spring extending through said threaded section into said interior space of said housing, a shaft, said shaft having a first terminus and second terminus, said first terminus being coupled to a respective one of said pair of ends of said spring within said interior space, said second terminus being coupled to said neck within said interior space, and wherein turning said base relative to said housing will rotate said spring through said threaded section, said spring thus inducing said shaft through said housing, such that said neck protrudes from said housing and forms said desired curvature of said neck; and said blade assembly comprising:

said safety blades being rectangular and having three openings, said covers having exterior faces, said exterior faces having an arcuate shape, said male cover having three cylindrical protrusions extending from an inner face, said protrusions being complementary in position relative to said openings in said safety blades, said female cover having three orifices, said orifices being complementary in position relative to said protrusions, said second coupler comprising a second plurality of arcuate protrusions extending from a cylinder coupled to said exterior face of said female cover in a direction opposite from said first plurality of arcuate protrusions, said second plurality of arcuate protrusions being complementary to said first plurality of arcuate protrusions wherein said first coupler is selectively couplable to said second coupler, wherein said second plurality of arcuate protrusions is positioned to receive said first plurality of arcuate protrusions, such that the user may twist said blade assembly relative to said first coupler to secure said blade assembly to said neck, and each of said spacers having three holes, said holes being complementary in position relative to said cylindrical protrusions, said plurality of spacers comprising from one to four spacers.

9. An adjustable shaving device comprising:

a housing, said housing being cylindrical, said housing having a first end and a second end, said second end comprising an orifice;

a neck, said neck being positioned in said orifice;

a first coupler, said first coupler being rotationally coupled to said neck;

a blade assembly, said blade assembly comprising:

a plurality of safety blades, a male cover and a female cover, said covers being complementary to said safety blades wherein said safety blades are positionable in said covers, a second coupler positioned on an exterior face of said female cover, said second coupler being complementary to said first coupler wherein said second coupler is selectively couplable to said first coupler, and a plurality of spacers, said spacers being complementary in shape to and positionable between said safety blades;

wherein said male cover and said female cover are configured to accept and secure said safety blades with one of each said plurality of spacers between adjacent said safety blades, and such that said first coupler is positioned to couple to said second coupler, securing said blade assembly to said housing and allowing rotational movement of said blade assembly relative to said housing;

a base, said base being rotationally coupled to said first end of said housing, said base having a bottom, said bottom being tapered relative to said base, said base comprising a plurality of longitudinal faces extending from said bottom toward said first end; and an adjuster, said adjuster being positioned in an interior space defined by said housing and said base, said adjuster comprising:

a threaded section, said thread section being positioned on an interior wall of said housing proximate to said first end, a stop, said stop being coupled to an internal wall of said base, a spring, said spring being complimentary to said threaded section wherein said spring is extendable through said threaded section to engage said threaded section, said spring having a pair of ends, a respective one of said pair of ends being coupled to said stop, said spring extending through said threaded section into said interior space of said housing, a shaft, said shaft having a first terminus and second terminus, said first terminus being coupled to a respective one of said pair of ends of said spring within said interior space, said second terminus being coupled to said neck within said interior space, and wherein turning said base relative to said housing will rotate said spring through said threaded section, said spring thus inducing said shaft through said housing, such that said neck protrudes from said housing.

10. The device of claim 9, further including an aperture, said aperture being positioned in said bottom of said base, wherein said aperture is positioned in said bottom allowing liquid to drain from said housing.

11. The device of claim 10, further including said aperture being square.

12. The device of claim 9, further including a grip, said grip being coupled to an exterior of said housing, said grip being pliable.

13. The device of claim 12, further including said grip being rubber.

14. The device of claim 12, further including said grip comprising a pair of grips positioned on opposing sides of said housing.

15. The device of claim 14, further including each of said pair of grips having a generally elongated rectangular shape.

16. An adjustable shaving device comprising:

a housing, said housing being cylindrical, said housing having a first end and a second end, said second end comprising an orifice;

a neck, said neck being positioned in said orifice;

a first coupler, said first coupler being rotationally coupled to said neck;

a blade assembly, said blade assembly comprising:

a plurality of safety blades, a male cover and a female cover, said covers being complementary to said safety blades wherein said safety blades are positionable in said covers, a second coupler positioned on an exterior face of said female cover, said second coupler being complementary to said first coupler wherein said second coupler is selectively couplable to said first coupler, and a plurality of spacers, said spacers being complementary in shape to and positionable between said safety blades;

wherein said male cover and said female cover are configured to accept and secure said safety blades with one of each said plurality of spacers between adjacent said safety blades, and such that said first coupler is positioned to couple to said second coupler, securing said blade assembly to said housing and allowing rotational movement of said blade assembly relative to said housing;

said first coupler comprising a first plurality of arcuate protrusions extending from a perimeter ring;

said second coupler comprising a second plurality of arcuate protrusions extending from a cylinder coupled to said exterior face of said female cover in a direction opposite from said first plurality of arcuate protrusions, said second plurality of arcuate protrusions being complementary to said first plurality of arcuate protrusions wherein said first coupler is selectively couplable to said second coupler; and wherein said second plurality of arcuate protrusions is positioned to receive said first plurality of arcuate protrusions, such that the user may twist said blade assembly relative to said first coupler to secure said blade assembly to said neck.

* * * * *